US008439389B2

(12) United States Patent
Moore et al.

(10) Patent No.: US 8,439,389 B2
(45) Date of Patent: May 14, 2013

(54) TOE UNIT FOR ALPINE TOURING BINDING

(75) Inventors: Robert E. Moore, North Vancouver (CA); Ernest D. McCrank, North Vancouver (CA); Cameron A. Shute, Nelson (CA)

(73) Assignee: G3 Genuine Guide Gear Inc., North Vancouver, BC (CA)

( * ) Notice: Subject to any disclaimer, the term of this patent is extended or adjusted under 35 U.S.C. 154(b) by 166 days.

(21) Appl. No.: 12/936,141

(22) PCT Filed: Apr. 3, 2009

(86) PCT No.: PCT/CA2009/000435

§ 371 (c)(1),
(2), (4) Date: Oct. 1, 2010

(87) PCT Pub. No.: WO2009/121187

PCT Pub. Date: Oct. 8, 2009

(65) Prior Publication Data

US 2011/0025003 A1 Feb. 3, 2011

Related U.S. Application Data

(60) Provisional application No. 61/064,925, filed on Apr. 3, 2008, provisional application No. 61/193,360, filed on Nov. 20, 2008, provisional application No. 61/193,893, filed on Jan. 5, 2009.

(51) Int. Cl.
*A63C 9/00* (2006.01)

(52) U.S. Cl.
USPC ..... 280/617; 280/11.33; 280/616

(58) Field of Classification Search ..... 280/607, 280/611, 624, 625, 626, 623, 618, 617, 633, 280/634, 11.33
See application file for complete search history.

(56) References Cited

U.S. PATENT DOCUMENTS 3,606,370 A * 9/1971 Spademan ..... 280/624
4,182,525 A * 1/1980 Spademan ..... 280/624

(Continued)

FOREIGN PATENT DOCUMENTS

AT 402020 1/1997
EP 1099098 10/1986

(Continued)

OTHER PUBLICATIONS

Information downloaded Oct. 10, 2012 from www.wildsnow.com including "Dynafit Back Country Skiing Bindings—Info Index" (pp. 3-5 of 12) and "Frequently Asked Questions (FAQ)" (pp. 1-3 & 10-13 of 15); posted Aug. 23, 2009 and updated Sep. 25, 2012.

(Continued)

*Primary Examiner* — Hau Phan

(57) ABSTRACT

An apparatus is provided for holding a footwear toe to a snow travel aid. The apparatus comprises jaws that grasp the toe while permitting pivotal movement of the footwear about the toe in forward and rearward directions and is for use with a heel holder that provides for lateral release. The apparatus comprises one or more resilient elements for biasing the jaws whereby the jaws are biased towards a closed position throughout the operational range of motion of the jaws. Also provided is an apparatus which comprises jaws that grasp the toe while permitting pivotal movement of footwear about the toe, wherein the apparatus is adapted for generally horizontal, forward and rearward translation relative to a longitudinal axis of the snow travel aid, selectively by a user. Also provided is an apparatus comprising jaws that grasp the toe while permitting pivotal movement of footwear about the toe, and a lock for inhibiting opening of the jaws, the lock comprising one or more resilient elements which provide resilience while inhibiting opening of the jaws.

24 Claims, 12 Drawing Sheets

U.S. PATENT DOCUMENTS

| | | | | |
|---|---|---|---|---|
| 4,348,036 | A | 9/1982 | Settembre | |
| 4,352,508 | A * | 10/1982 | Spademan | 280/624 |
| 4,395,055 | A * | 7/1983 | Spademan | 280/624 |
| 5,240,275 | A * | 8/1993 | Jungkind | 280/618 |
| 6,343,809 | B1 * | 2/2002 | Karol | 280/613 |
| 6,375,212 | B1 * | 4/2002 | Hillairet et al. | 280/617 |
| 6,585,282 | B2 * | 7/2003 | Merino et al. | 280/634 |
| 7,047,673 | B2 * | 5/2006 | Dodge | 280/618 |
| 8,181,985 | B2 | 5/2012 | Mangold et al. | |

FOREIGN PATENT DOCUMENTS

| | | |
|---|---|---|
| EP | 1559457 | 8/2005 |
| WO | 2007/010392 | 1/2007 |

OTHER PUBLICATIONS

English Abstract. EP1559457. Aug. 3, 2005.

* cited by examiner

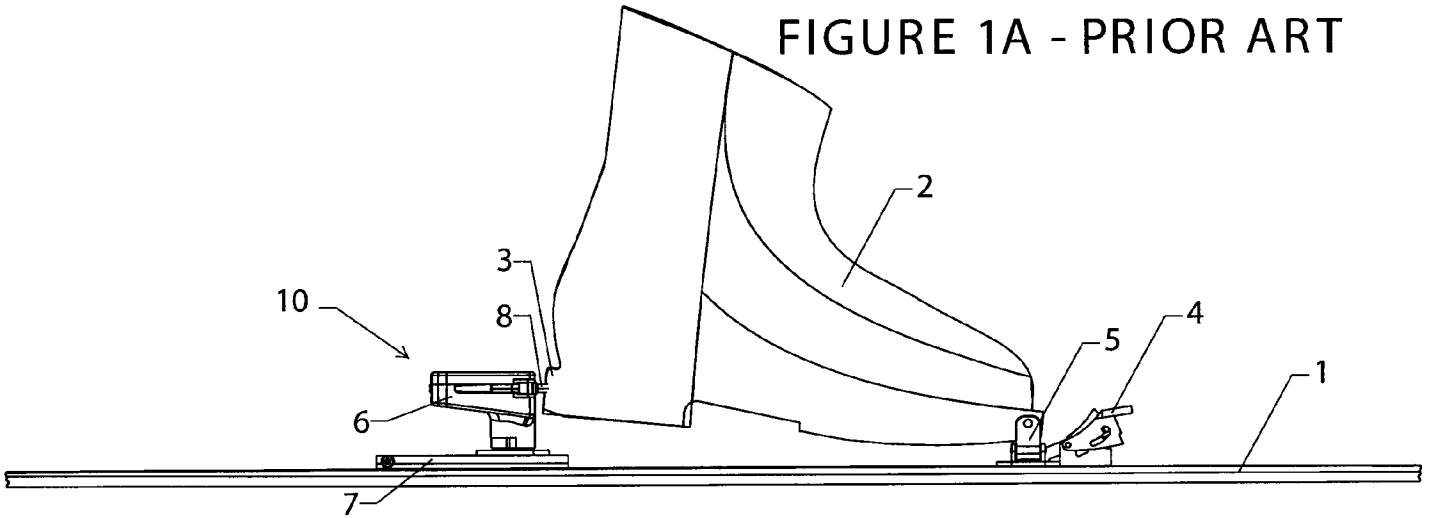
FIGURE 1A - PRIOR ART
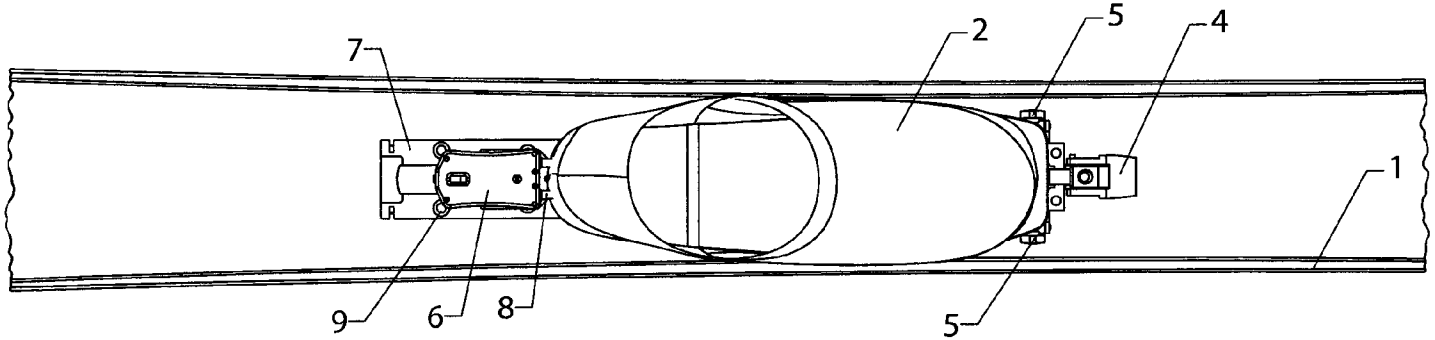
FIGURE 1B - PRIOR ART

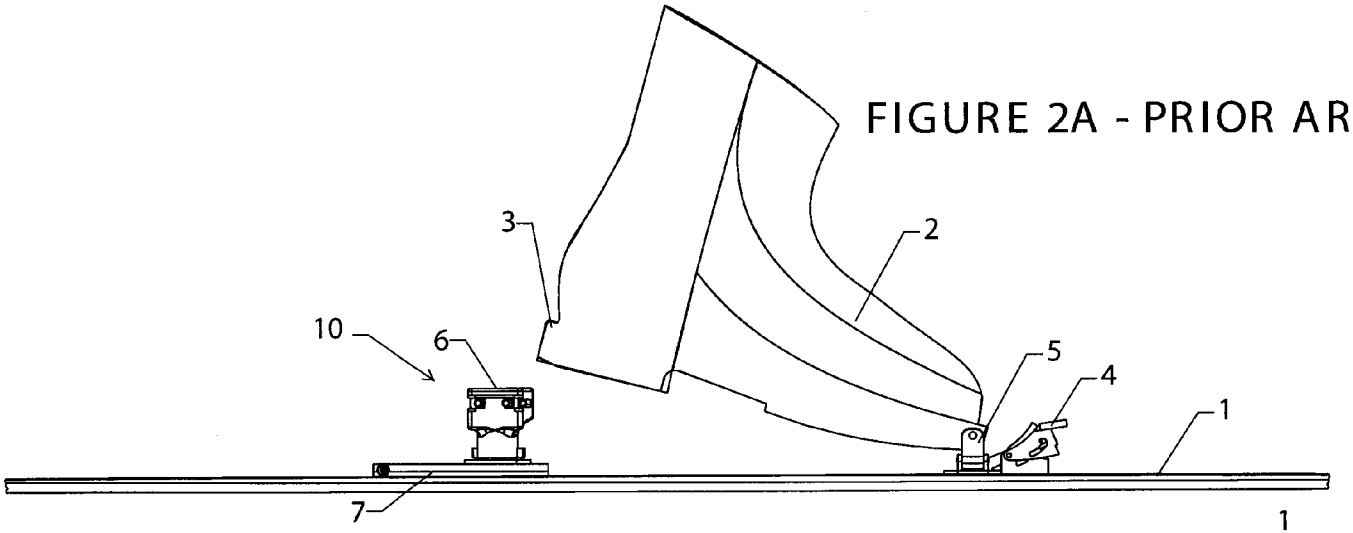
FIGURE 2A - PRIOR ART
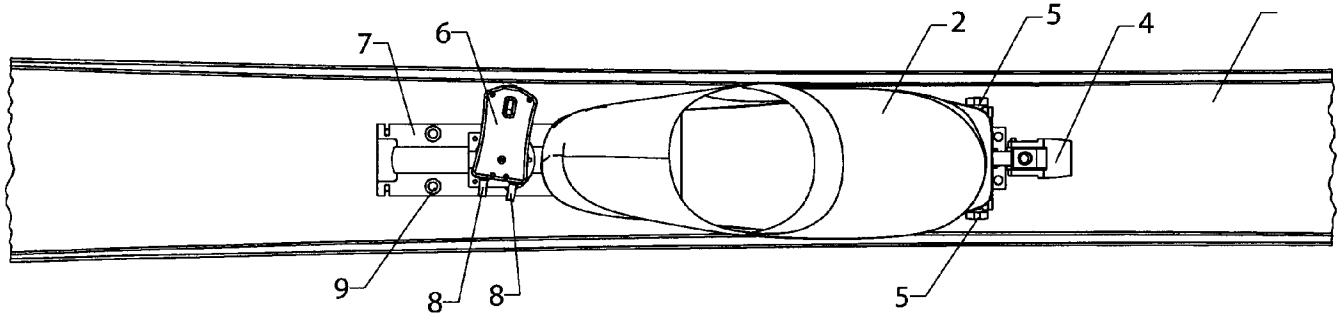
FIGURE 2B - PRIOR ART

TOE UNIT FOR ALPINE TOURING BINDING

RELATED APPLICATIONS

This application claims priority from U.S. patent applications 61/064,925 filed Apr. 3, 2008; 61/193,360 filed Nov. 20, 2008; and 61/193,893 filed Jan. 5, 2009.

FIELD OF THE INVENTION

This invention relates to the toe unit of release bindings used in alpine ski touring, also known as "Randonnee". More particularly, this invention relates to such toe units which grasp the toe of the user's footwear and permit pivotal motion about the toe in forward and rearward directions generally parallel to a longitudinal axis of a snow travel aid, when the footwear heel is detached from the snow travel aid.

BACKGROUND OF THE INVENTION

Alpine touring bindings allow the heel of the user's footwear (such as a ski boot) to be latched to a snow travel aid (such as a ski), for sliding downhill (the "downhill mode") and allow the heel to be released for walking and climbing (the "touring mode"). Release bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wildsnow.com, authored by Louis Dawson.

Alpine touring bindings sold under the brand DYNAFIT are release bindings that take advantage of the fact that modern alpine touring boots have a rigid sole. Thus, it is unnecessary to provide a bar, plate or other arrangement connecting the toe and heel units, as is the case with many other alpine touring bindings (see patent publications EP0199098, EP0519243, EP1559457, and AT402020). Unlike other release bindings, lateral release of the DYNAFIT™ system is provided at the heel, not the toe.

The DYNAFIT™ binding system comprises a toe unit which has a set of laterally oriented jaws. Such jaws open and close in a direction generally perpendicular to the longitudinal axis of a ski or other snow travel aid so as to grasp opposite sides of the toe region of the user's footwear. The axes of rotation of each jaw in the DYNAFIT™ system is oriented generally parallel to the longitudinal axes of the snow travel aid. The toe unit is mounted at an appropriate location on the upper surface of the snow travel aid. A separate heel unit is mounted at a particular region on the upper surface of the snow travel aid rearward of the toe unit, the location of which is dictated by the length of the footwear sole. The heel unit typically comprises two pins which extend forward to engage opposite sides of a fitting placed over a cavity in the rear of the footwear heel. Under forward release conditions, the pins are forced apart against spring pressure to disengage from the fitting.

Lateral release in the DYNAFIT™ system is provided by the heel unit being rotatable on a generally vertical post. Adjustment of the lateral release is done by altering resistance to rotation of the heel unit. While the jaws of the toe unit open, they do so with a relatively high resistance to force in order to provide a constrained fulcrum that acts as the pivot point for the lateral release feature of the binding system. Thus, the toe unit of a DYNAFIT™ system is not considered a lateral release toe unit such as is employed in other binding systems. An example of a binding system in which the toe unit is a lateral release toe unit containing jaws for grasping the toe is described in WO2007/010392. The latter binding system operates differently from the DYNAFIT™ system because the toe unit rather than the heel unit provides lateral release.

To switch between touring and downhill modes with the DYNAFIT™ system, it is necessary to rotate the heel unit so that the pins either engage the footwear heel (downhill mode) or face away from the heel (touring mode). When the pins are facing away, the heel is free to move upward and downward with the toe of the footwear being pivotally engaged to the toe unit. In order to switch from downhill mode to touring mode it is necessary to either forcibly release the pins from the fitting on the heel (not recommended) or disengage the jaws of the toe unit from the footwear toe, so that the footwear completely exits from the binding system whereupon the heel unit may be rotated to a position in the touring mode. Subsequent re-entry of the toe into the toe unit is then required. This process is time consuming and can be difficult to do in deep snow or on a steep slope, for the reasons discussed below.

The jaws of a DYNAFIT™ binding system toe unit open by spreading outwards away from the longitudinal midline of a snow travel aid. Each jaw has an arm that extends towards the midline. Each arm has an end that abuts the other in an end-to-end manner. In the commercial embodiment, one such end engages a recess in the other end. In each of the open and closed positions, the jaw arms ends are in an over-centre position and springs bias the jaws towards either the fully opened or the fully closed positions. Each jaw has a generally conical "tooth" which laterally engages a corresponding fitting embedded on the side of the toe region of the footwear sole. When the jaws are closed and engage these fittings, the toe is retained adjacent the upper surface of the snow travel aid but the footwear is able to pivot in a forward or backward direction to facilitate walking and climbing. A catch is provided to prevent the jaws from inadvertently opening as a result of application of force sufficient to overcome the spring pressure, and is used when the toe unit is in the touring mode. The catch is usually disengaged in the downhill mode so as to not prevent release of the footwear during a fall. The user enters the toe unit by carefully positioning the footwear toe between the jaws so that the teeth will engage the toe fittings when the toe is depressed, causing the jaws to close. This manoeuvre requires patience and practice.

Since the jaws in the DYNAFIT™ system toe unit make use of an "over-centre" arrangement to retain the jaws in either the open or closed position, the distance between the tooth of each jaw and the footwear toe is substantial when the jaws are in the fully opened position. This makes it difficult for the user to confidently align the toe between the jaws, particularly if the toe and/or binding is visually obscured by snow or the snow travel aid is resting on an inclined snow surface.

EP1559457 discloses an improvement in the DYNAFIT™ system boot toe fitting which is intended to assist the user in entering the toe unit. This improvement involves the presence of flanges on the toe fittings, which define a vertical groove in the fitting. The flanges come closer to the teeth of the binding jaws when the binding is in the open position than is the case with previous fittings and help guide the user to place the toe in the most appropriate position (see FIG. 6 of EP1559457). Nevertheless, practise is still required for the efficient use of the binding and it is not practical to retrofit the improved fittings into footwear containing the previous fittings.

SUMMARY OF THE INVENTION

Various embodiments of this invention provide an apparatus for holding a footwear toe to a snow travel aid while the heel of the footwear is detached from the snow travel aid. The apparatus comprises jaws that grasp the toe while permitting pivotal movement of the footwear about the toe in forward and rearward directions. The apparatus comprises one or more resilient elements for biasing the jaws, wherein the jaws are biased towards a closed position throughout the operational range of motion of said jaws. These embodiments are for use with a heel holder that is disengageable from the footwear heel and provides for lateral release when engaged with the heel. Also provided is a kit comprising the aforementioned apparatus and a heel holder that provides for lateral release. Also provided is the aforementioned apparatus in combination with a heel holder that rotates to provide for lateral release, the combination being mounted on the snow travel aid.

Various embodiments of this invention provide an apparatus for holding a footwear toe to a snow travel aid, the apparatus comprising jaws that grasp the toe while permitting pivotal movement of the footwear about the toe in forward and rearward directions, wherein the apparatus further comprises a lock for inhibiting opening of the jaws, the lock comprising one or more resilient elements for providing resilience while inhibiting opening of the jaws.

Various embodiments of this invention provide an apparatus for holding a footwear toe to a snow travel aid, the apparatus being one which comprises jaws that grasp the toe while permitting pivotal movement of the footwear about the toe in forward and rearward directions, wherein the apparatus is adapted for generally horizontal, forward and rearward translation relative to a longitudinal axis of the snow travel aid, selectively by a user.

This invention relates to a toe unit for an alpine touring binding comprising jaws that pivotally engage opposite sides of a footwear toe, wherein the jaws are constantly biased by one or more resilient elements towards a closed position. In some embodiments, the jaws do not pass a centre-point position when moving between opened and closed positions. The jaws may be restrained in the open position against the biasing of the resilient elements by means of a movable stop. The movable stop may comprise a wedge and/or be placed beneath the jaws. The movable stop may be actuated by means of a lever. A lever may be used to cause the jaws to move from a closed to an open position. Some embodiments may further comprise a trigger for engaging the sole of a user's boot which releases a catch and permits the binding to automatically move from an open to a closed position as a result of biasing by the resilient elements.

This invention also relates to a toe unit for an alpine touring binding comprising jaws that pivotally engage opposite sides of a footwear toe, wherein the toe unit comprises a lever for actuating said jaws, the lever further actuating a toe stop positioned forward of the toe, wherein movement of the lever to close the jaws translates the boot stop away from the toe and movement of the lever to open the jaws translates the boot stop to be positioned in front of the toe.

In various embodiments of this invention, a generally spherical bearing is provided for articulation between opposing jaws of an alpine touring binding toe unit.

This invention also relates to a toe unit adapted to be moved forward and rearward in a generally horizontally manner on the snow travel aid to provide a means for disengaging the footwear heel from a heel unit of an alpine touring binding (such as a DYNAFIT™ type heel unit). A mechanism may be provided for causing the toe unit to move forward and rearward and a mechanism may be provided for restraining the toe unit in a forward or rearward position or both so that the heel unit will remain in a rearward position for the downhill mode and in a forward position for the touring mode. In the touring mode, the heel is free from the heel unit because of the footwear attached to the toe unit being in a more forward position.

BRIEF DESCRIPTION OF THE DRAWINGS

FIGS. 1A and 1B are side and plan views, respectively of a ski, ski boot and a prior art binding system.

FIGS. 2A and 2B are side and plan views, respectively showing the combination illustrated in FIGS. 1A and 1B in a touring mode.

DETAILED DESCRIPTION OF PARTICULAR EMBODIMENTS OF THE INVENTION

Figure 3:
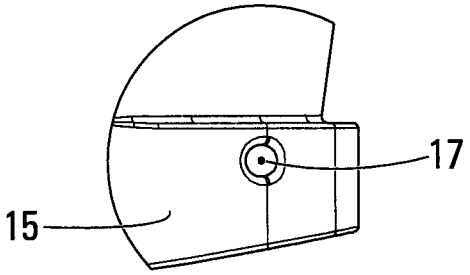
FIG. 3 Prior Art
FIG. 3 is a partial end view of a boot toe containing a prior art fitting for a jaw "tooth" of a prior art heel unit.

Snow travel aids as contemplated herein are devices that support a user and are adapted to slide on a snow surface. Examples include skis, other snow sliding devices shaped like a ski and snowboards. This includes devices known as "splitboards" (which are snowboards that can be separated longitudinally into at least two portions, the two portions then functioning in a manner similar to a pair of skis). Examples of such other devices include "ski blades", "snow blades", "ski boards", and "sliding" or "gliding snow shoes". An example of the latter device is the configurable snow shoe/ski device described in WO 2000/044846.

In this specification, "lateral release" involves torque applied about an axis that is generally perpendicular to the upper surface of a snow travel aid. In the DYNAFIT™ system and in a binding of this invention, the axis is situated at the toe rather than the heel.

In this specification, reference to "generally vertical" is intended to indicate a general direction upwards or downwards from a reference but does not require perpendicularity to such reference. Conversely, the term "generally horizontal" would include directions that are perpendicular to those which are "generally vertical" but are not limited to situations involving a line or a plane parallel to the reference. The latter two terms also include lines or planes that are curved relative to the reference and extend in generally vertical or horizontal directions from the reference. In addition, the terms "generally horizontal" and "generally parallel" include lines or planes that are parallel to a reference as well as those which form an angle of less than 45 degrees with the reference or which are curved and follow a direction that is generally parallel to the reference. The term "generally perpendicular" is not limited to a 90 degree orientation but includes orientations that form an angle to a reference of greater than 45 degrees and less than 135 degrees. The term "generally spherical" includes any shape comprising one or more portions of a surface of a sphere.

FIGS. 1A and 1B show the prior art DYNAFIT™ binding system, including toe unit 4 and heel unit 10 mounted on the upper surface of ski 1. The toe unit comprises jaws 5 that pivotally engage with special fittings (not shown) embedded in the toe of ski boot 2. Dual pins 8 on heel unit 10 engage the rear portion of the boot heel 3. The heel unit comprises a base plate 7 fixed to the ski surface by multiple fasteners 9. Upper portion 6 of the heel unit contains forward directed projections, which are illustrated as a pair of pins 8. The arrangement shown in FIGS. 1A and 1B is the downhill mode with both the toe and heel of the boot engaged by the binding system.

FIGS. 2A and 2B show the prior art DYNAFIT™ system positioned in the touring mode. The toe of the boot remains pivotally engaged to toe unit 4. The heel is free to move up and down relative to the ski because upper portion 6 of the heel unit has been rotated so that pins 8 face away from boot heel 3. In some DYNAFIT™ models, upper portion 6 may be further rotated (not shown) such that pins 8 face rearward of the ski thereby allowing the boot heel 3 to come to rest on an upper surface of upper portion 6. This reduces stress on the user's muscles and tendons while climbing steep hills.

In order to switch from the downhill mode shown in FIGS. 1A and 1B to the touring mode shown in FIGS. 2A and 2B, one must free the pins 8 from the boot heel. The usual method for doing so is to disengage the boot toe from jaws 5, thereby completing exiting the binding system at which point the user is no longer engaged with the snow travel aid. This is a disadvantage in deep snow. Furthermore, the snow travel aid must be prevented from sliding away without the user attached.

FIG. 3 is a part-circular side view of a cut-away portion of the toe of an alpine touring boot containing a standard fitting for engaging a tooth on the jaw of a DYNAFIT™ toe unit. Shown is the front side portion of the boot sole 15 in the region of the toe of boot 2. Embedded therein is a metallic insert 17 which presents a concavity negatively corresponding in shape to a tooth on the jaw of a DYNAFIT™ toe unit. A similar concavity is presented on the other side of the boot toe for receiving the other tooth present on the other jaw of the toe unit.

Figure 4:
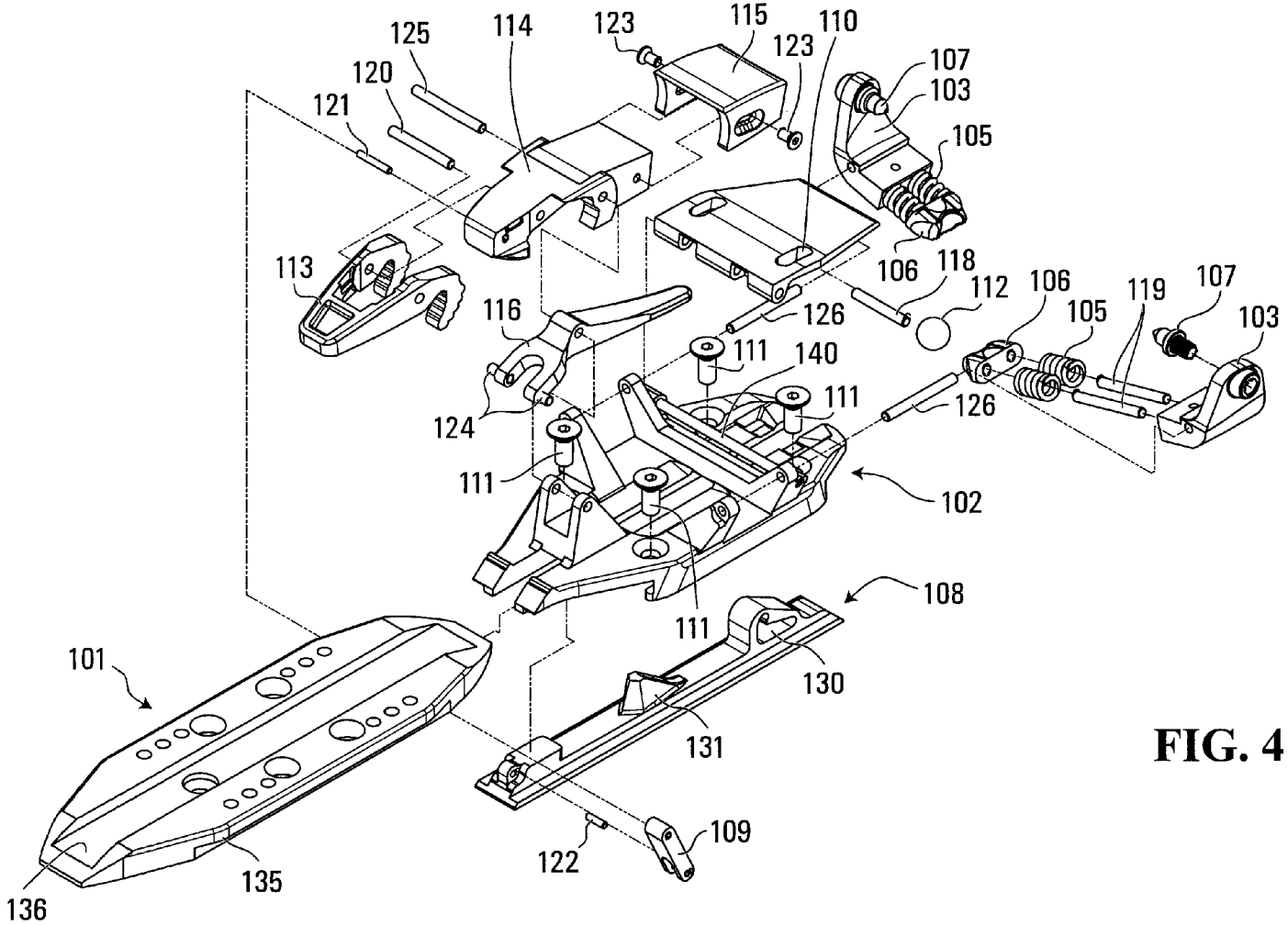
FIG. 4 is an exploded view of a toe unit of this invention.

FIG. 4 is an exploded view of a particular embodiment of a toe unit of this invention which combines the various features described above in a single apparatus. The dotted lines illustrate location and direction of engagement of various pins which act as pivots for articulation of the various components.

Base plate 101 contains a series of holes for receiving fasteners intended to attach the base plate to the upper surface of a snow travel aid. In this embodiment, the base plate also contains elements for receiving threaded fasteners 111 for attaching a chassis 102 to a desired location on the base plate. In this embodiment, base plate 101 has on opposite sides flanges 135 which cooperate with opposing flanges on the under surface of chassis 102 to provide for sliding engagement of the chassis on the base plate. Chassis 102 has, on its upper surface, pairs of pillars on opposite sides thereof for receiving pins 126, each of which articulates a jaw 103 so that each jaw can move between open and closed positions. Each jaw contains tooth 107, which in this embodiment is a separate fitting that is threaded into a corresponding opening in the jaw and has a generally conical end for engagement with a boot fitting such as that shown in FIG. 3. Two pins 119 engage coil springs 105 which in turn engage female plunger 106. The latter elements form an arm of the jaw and corresponding elements are present on the opposite jaw. Retained between each of the female plungers 106 when assembled, is pivot ball 112 which provides a spherical bearing surface that engages both female plungers. The jaw components do not pass through the centre-point of an arrangement when moving to the open position from the closed position. Thus, at all times, springs 105 bias the jaws towards the closed position.

The lower surface of a free end of control arm 116 rests against an upper surface of pivot ball 112 and is used to restrain the jaws in the closed position. When so restrained the jaws are "locked" in the touring mode position. Control arm 116 is a lever having its fulcrum at pivot pin 125. Pin 125 articulates the control arm to step-in lever 114 and a pair of pillars at the front end of chassis 102. At the opposite end of control arm 116 from the free end is a yoke. Extending from opposite sides of the yoke are posts 124 which engage in a hook on tour mode lever 113 when in the locked position. Tour mode lever 113 itself is pivotally engaged via pin 120 to step-in lever 114. Tour mode lever 113 has a free end that acts as a handle which permits the user when pulling the handle upward to engage posts 124 on control arm 116 thereby placing the binding in the locked position.

A rear portion of step-in lever 114 engages boot-stop 115. When the forward end of lever 114 translates upward as in the downhill mode position (when the jaws are closed but not locked), boot-stop 115 is translated downward so that it does not interfere with pivoting of the footwear toe. When the front end of lever 114 is depressed to cause the jaws to open, boot-stop 115 becomes angled upward so as to provide a stop surface just in front of the footwear toe when the footwear is in the proper location for entry into the binding. In the illustrated embodiment, a pair of threaded fasteners 123 engage in openings in the sides of boot-stop 115 and fasten to the rear portion of step-in lever 114. By loosening fasteners 123, the position of boot-stop 115 relative to step-in lever 114 can be adjusted to provide an appropriate clearance between the rearward edge of boot-stop 115 and the toe of a particular article of footwear. The presence of a boot-stop can assist the user in correctly placing the footwear when entering the binding.

At the front of step-in lever 114 opposite boot-stop 115, is pivot pin 121 that pivotally engages the upper part of actuator link 109, the lower portion of which is pivotally engaged by pin 122 in the front end of sliding plate 108. This arrangement allows for plate 108 to move forward or rearward relative to chassis 102 by moving step-in lever 114 upward or downward. Plate 108 slides along in slot 136 in the upper surface of base plate 101. At an intermediate point on the upper surface of plate 108 is wedge 131 which engages the lower surface of pivot ball 112. When the binding is not in the locked position and plate 108 is caused to move rearward, wedge 131 forces pivot ball 112 upward against the force of springs 105, thereby causing jaws 103 to move to the open position. On a rearward portion of plate 108 is a shaped passage 130 containing a recess. Pivot pin 118 extends through passage 130 and is pivotally engaged on the under surface of trigger plate 110. When plate 108 is in the rearward position and the jaws are in the open position, pin 118 becomes engaged in the recess portion of passage 130 thereby retaining plate 108 at that position and preventing spring 105 from causing the jaws to close. When the user steps on trigger plate 110, pin 118 is forced out of the recess in passage 130, and plate 108 is able to move forward. As the wedge 131 moves forward it allows pivot ball 112 to descend. This causes the jaws, which are biased by spring 105 to close. Pin 140 articulates the front portion of trigger plate 110 to chassis 102.

When entering and closing the illustrated binding, the user does not have to cause the binding components to travel through an "over-centre" range of motion while attempting to maintain a correct position for engagement of the jaws with the boot. Also, because this binding does not use an "over-centre" mechanism, the teeth of the jaws can be configured to be positioned very close to the fitting on the sides of a footwear toe when in the open position. For example, the distance between tips of the jaw teeth when the jaws are fully open may be in the range of about 63.0 mm to about 69.0 or 70.0 mm, which would provide for such close positioning of the teeth to typical boot fittings currently employed in the industry. This allows for accurate alignment by the user without using special fittings. Furthermore, since this device does not use an "over-centre" arrangement, only a slight downwards motion on trigger plate 110 is required to cause the jaws to close, thus reducing difficulty in closing the binding while maintaining a correct position of the footwear.

Figure 5A:
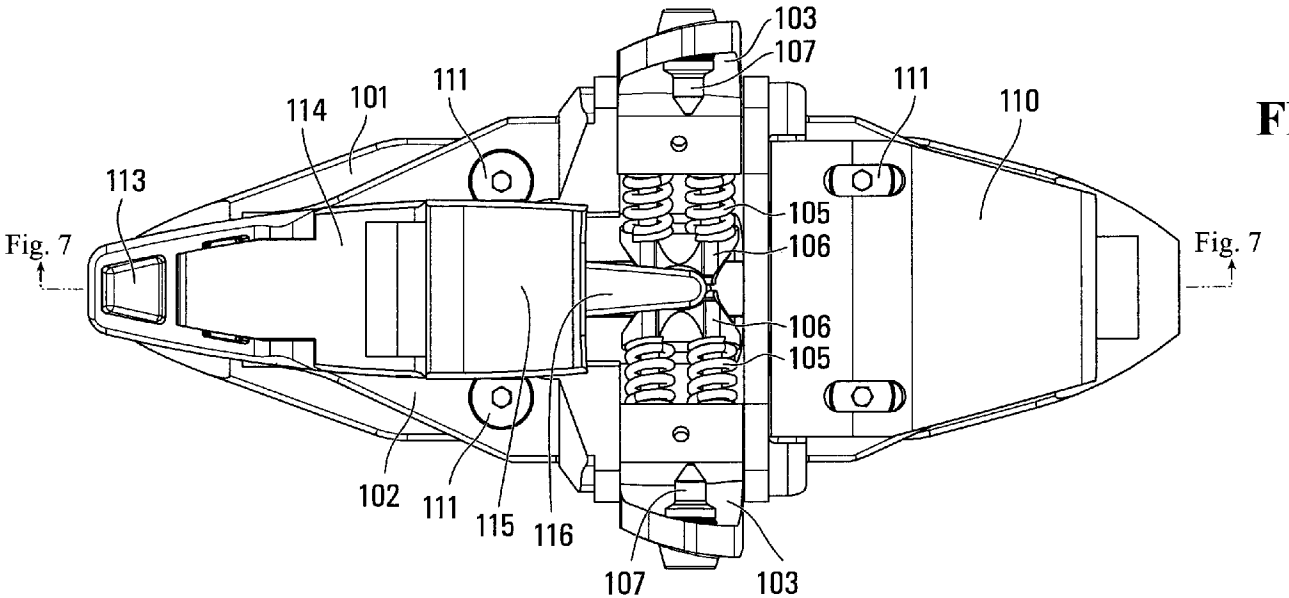
FIGS. 5A and 5B are top and side views of the toe unit shown in FIG. 4.
Figure 5B:
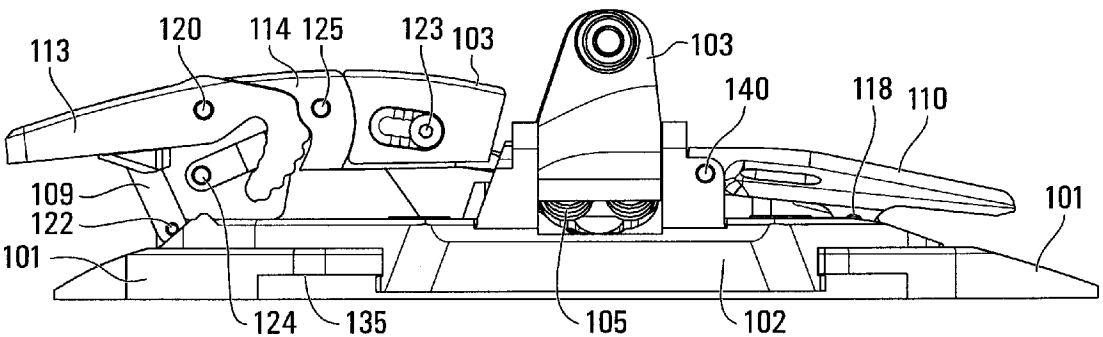

FIGS. 5A and 5B are top and side views, respectively, of an assembled toe unit as shown in FIG. 4. In these drawings, the toe unit is in the downhill mode position, that is, the jaws are closed but the binding is not locked. The components are identified by the same reference numerals as in FIG. 4.

Figure 6A:
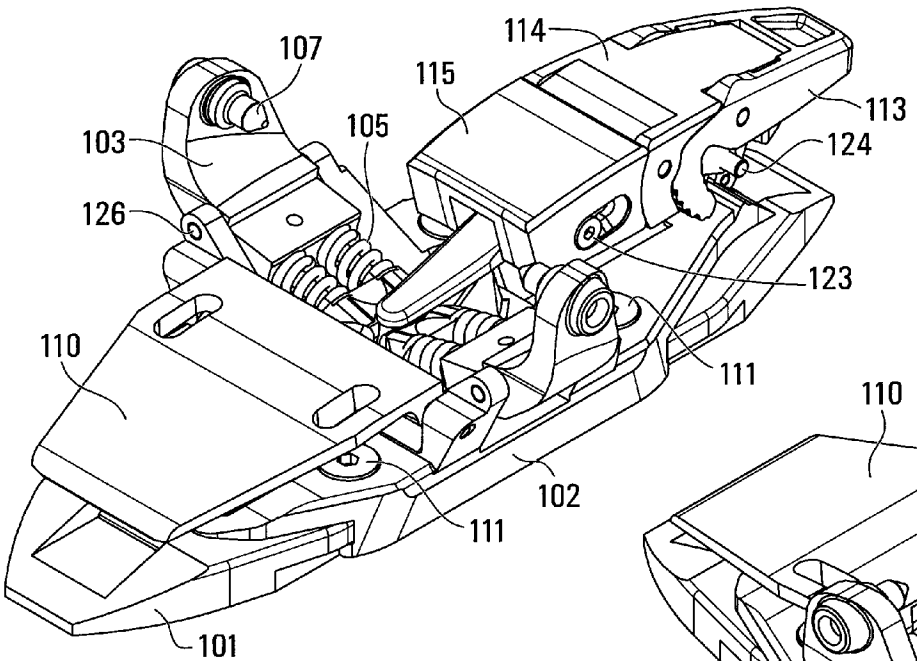
FIGS. 6A and 6B are perspective views of the toe unit shown in FIGS. 5A and 5B.
Figure 6B:
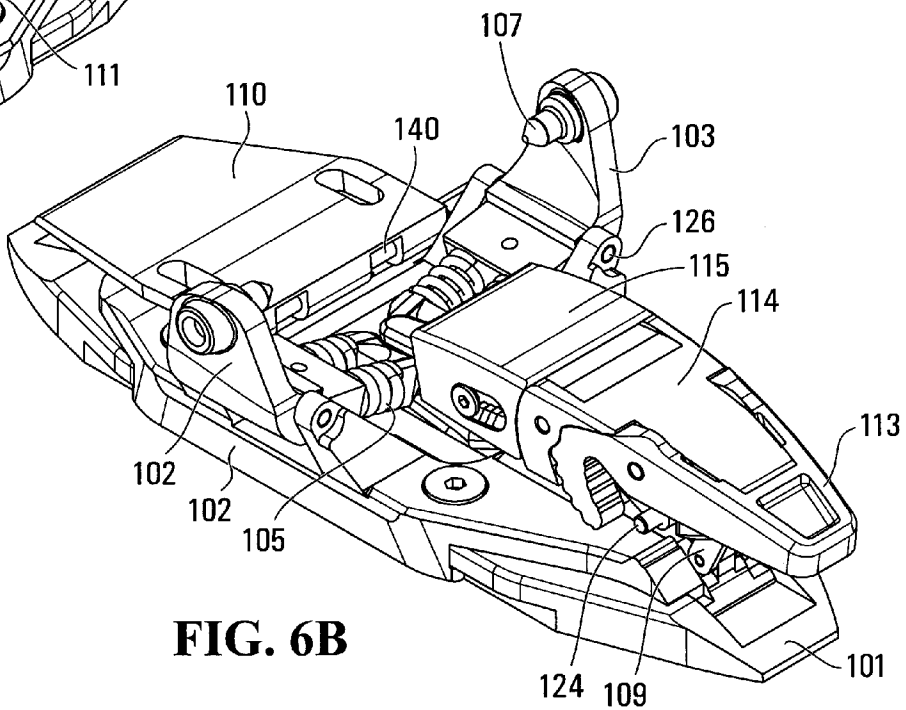

FIGS. 6A and 6B are separate perspective views of the toe unit shown in FIGS. 5A and 5B. Equivalent reference numerals are employed.

Figure 7:
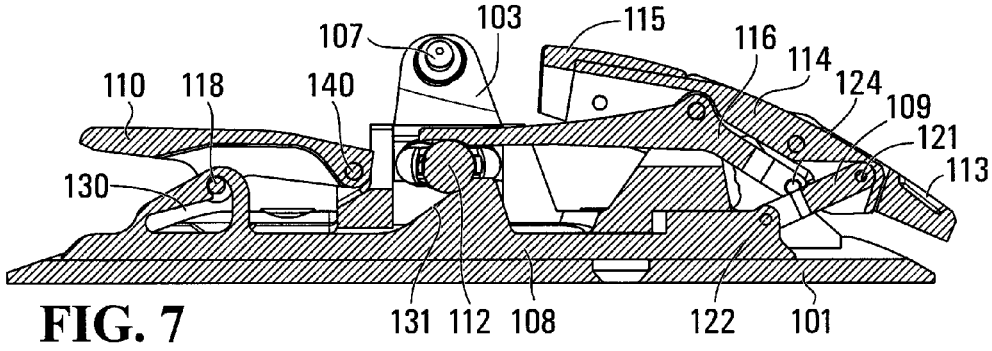
FIGS. 7-9 are cross-section views of the toe unit along a line from points A-A shown in FIG. 5A.
Figure 8:
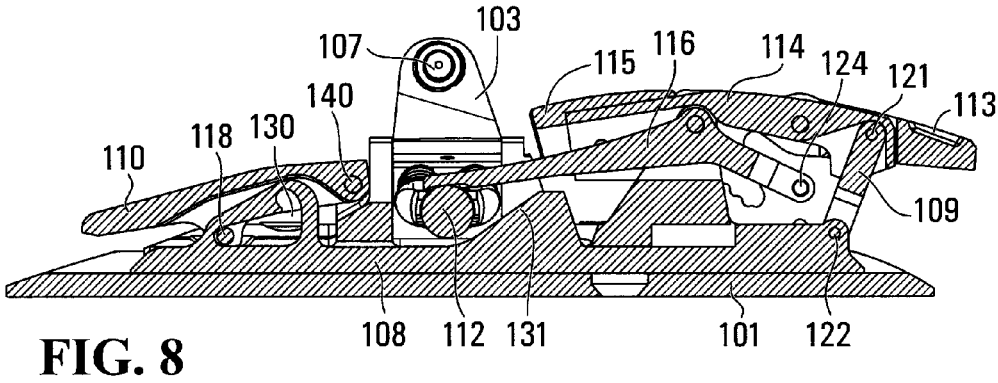
Figure 9:
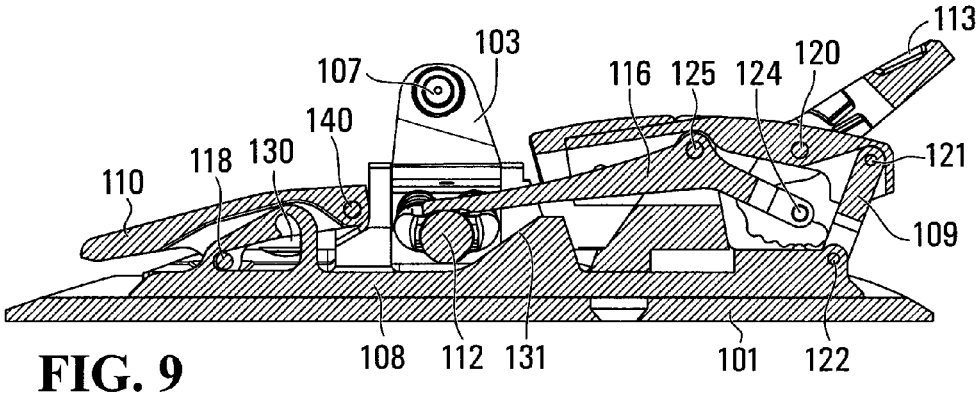

FIGS. 7-9 are cross-section views of the toe unit taken along a line from points A-A as shown in FIG. 5A. FIG. 7 shows the toe unit with the jaws open ready for the user to "step-in" by placing the boot toe between the jaws and by slightly depressing trigger plate 110. Boot-stop 115 is in an upwards position ready to prevent forward translation of the boot toe. The remaining reference numerals are as in preceding drawings. Pin 118 is engaged in the recess at the top of passage 130. Wedge 131 restrains ball 112 in an upward position and consequently retains the jaws in an open position.

FIG. 8 shows the toe unit in the downhill mode, that is, with the jaws closed and trigger plate 110 translated downwards beyond the point where the closing mechanism was actuated. Boot-stop 115 has also translated downwards to prevent interference with the boot toe and the binding is not in the locked position. Pin 118 has moved out of the recess in passage 130 and wedge 131 has moved forwards permitting ball 112 to descent and the jaws to close.

FIG. 9 shows the toe unit in the touring mode, that is, with the jaws closed and the toe unit locked. This has been accomplished by translating tour mode lever 113 upwards thereby engaging hook region 113A of the tour mode lever beneath posts 124 thereby preventing that end of control arm 116 from translating downwards and consequently, restraining ball 112 in a downward position with the jaws closed.

Figure 10:
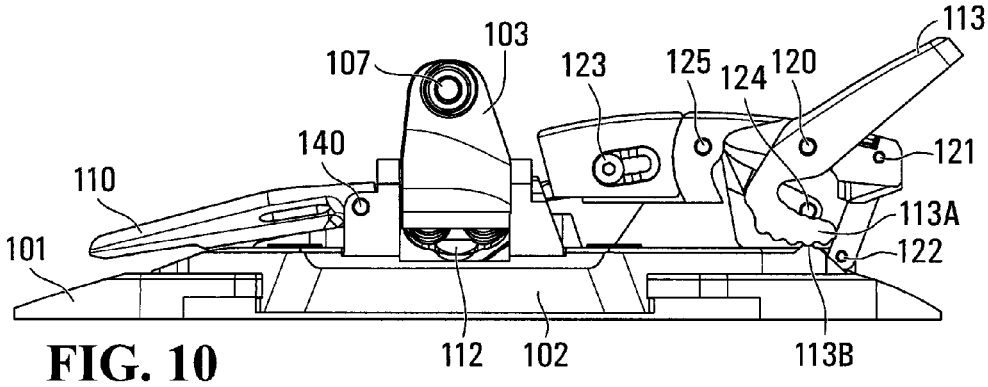
FIG. 10 is a side view of the toe unit shown in FIG. 9.

FIG. 10 is a side view of the toe unit illustrated in FIG. 9, locked in the touring mode position with hook region 113A of tour mode lever 113 engaged beneath post 124. Serrations 113B engage an upper surface of chassis 102, tending to prevent lever 113 from returning to the unlocked position.

Figure 11:
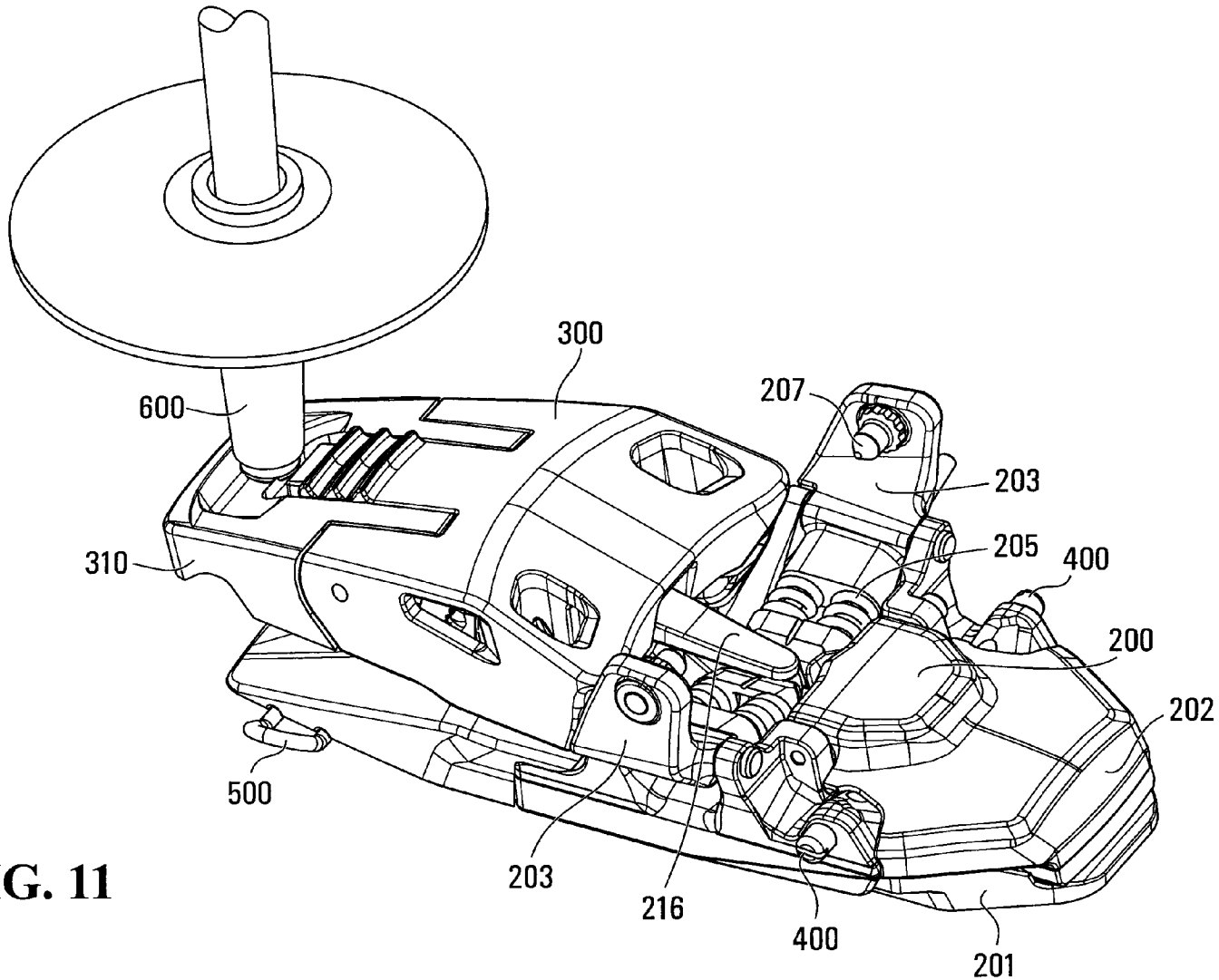
FIG. 11 is a perspective view of another toe unit of this invention.

FIG. 11 is a perspective view of an alternate embodiment of a toe unit of this invention shown in downhill mode position with the tip of a user's pole 600 poised to cause the toe unit to move to a "step-in" position whereby the user may engage the toe unit with the ski boot. This embodiment does not employ the trigger plate and accompanying mechanism described above for the preceding embodiment. Instead, the user presses down on lever 310 by using a ski pole or other implement or directly by hand to cause jaws 203 to open to permit entry of the boot toe. The jaws are retained in an open position by continued pressure on lever 310. Release of lever 310 allows the jaws to return to the closed position as a result of the constant bias to the closed position by springs 205 in the manner described in the embodiment above. This embodiment is less complex yet still facilitates boot entry into the toe unit by the positioning of pins 207 close to the sides of the boot toe, which is made possible by the jaws 203 not being arranged in an "over-centre" manner and being constantly biased to the closed position. In this embodiment, constant pressure downwards on lever 310 helps hold the ski and binding in position while the user places the boot toe between the jaws. Again, maximum opening of the jaws may be in the range of about 63.0 mm to about 69.0 or 70.0 mm. However, instead of stepping down on a trigger (as in the previous embodiment) the user simply releases pressure from lever 310 causing the jaws to close. Also illustrated in this drawing is base plate 201 and chassis 202. Rather than a trigger plate at the rear of the toe unit in this embodiment, the rear portion of chassis 202 comprises raised support region 200 for contacting the footwear sole behind/adjacent the footwear toe while the user steps into the toe unit. This helps to locate the footwear during step in. Preferably, the latter support does not contact the sole once the jaws are closed and engaged with the footwear. This embodiment employs control arm 216 for the same purposes as in the preceding embodiment. This embodiment employs pivoting cowling 300. Also illustrated are engagement posts 400 for attaching a ski crampon and loop 500 for attaching a "runaway" strap (if desired).

Figure 12A:
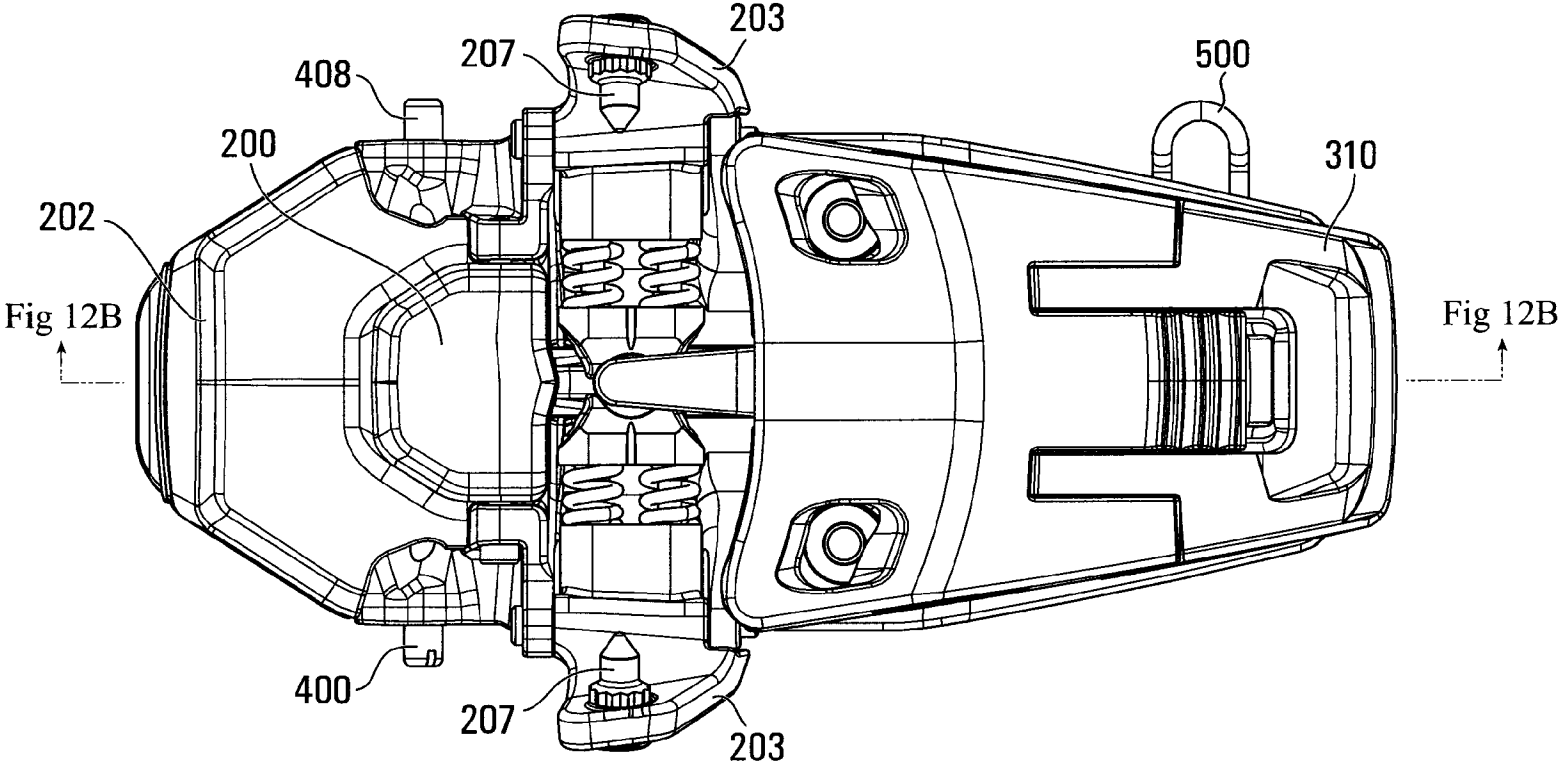
FIG. 12A is a plan view of the toe unit shown in FIG. 11.
Figure 12B:
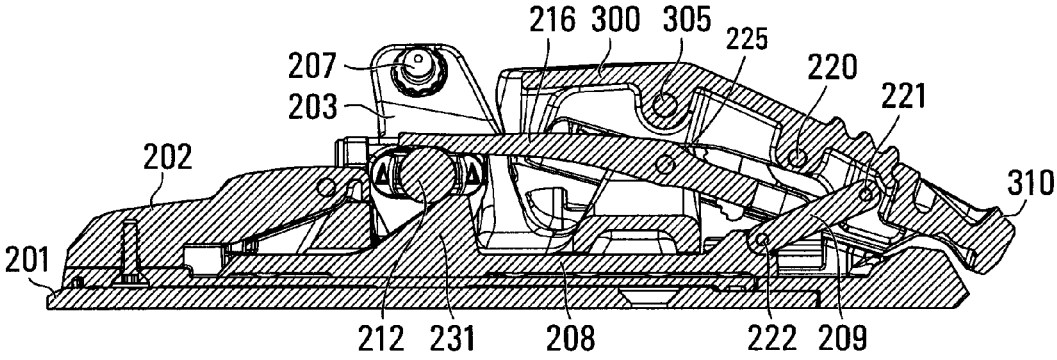
FIGS. 12B-12D are cross-section views taken along line A-A as referenced in FIG. 12A.

FIG. 12A is a plan view of the embodiment shown in FIG. 11. FIG. 12B is a cross-section along line A-A shown in FIG. 12A. As in the preceding embodiment, the toe unit contains a sliding plate 208 having ledge 231 which engages bearing 212 to open jaws 203. Absent are the rearwardly situated components of sliding plate 208 shown in the previous embodiment which were used to retain the previous embodiment toe unit in an open position. The toe unit shown in FIG. 12B is in the position that it would be in when lever 310 is being depressed by the user. Lever 310 is attached to cowling 300 at pivot joint 220 which permits lever 310 to move upwards relative to cowling 300 but the arrangement is such that downward pressure on lever 310 causes cowling 300 to itself pivot relative to its support on pivot 305. Downward pressure exerted by lever 310 causes sliding plate 208 to move rearwards to the position shown in FIG. 12B via link 209 which is pivotally connected at 221 and 222 to cowling 300 and sliding plate 208, respectively. As shown in FIG. 12B, wedge 231 forces bearing 212 upwards.

Figure 12C:
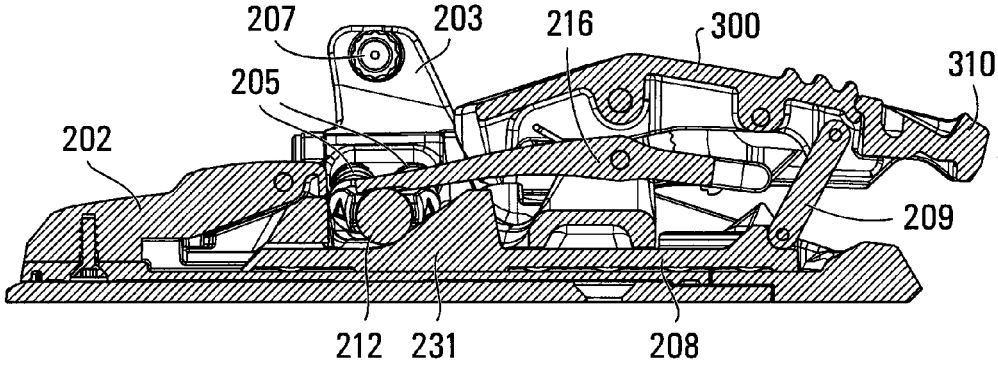

FIG. 12C is a further cross-section along line A-A of FIG. 12A. In this instance, the toe unit is in the downhill mode position whereby pressure is no longer applied to lever 310. In this position, springs 205 which bias jaws 203 to the closed position cause bearing 212 to force wedge 231 rearward, thereby ultimately causing toe cowling 300 and lever 310 to remain in an upward position. In this position, the jaws are closed but can open by biasing springs 205, to provide release during a fall.

Figure 12D:
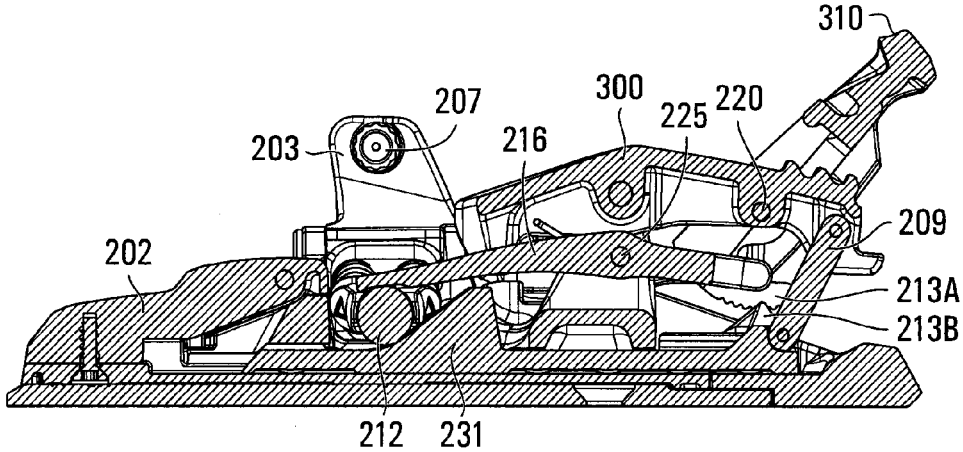

FIG. 12D is a further cross-section along line A-A of FIG. 12A. In this instance, the toe unit is shown locked in the touring mode position. Jaws 203 are retained in a closed position by the free end of control arm 216 pressing downwards on bearing 212. In this embodiment, control arm 216 is pivotally engaged to the chassis separate from toe cowling 300 at pivot 225. The forward end of control arm 216 is restrained in a manner similar to that shown in the previous embodiment when lever 310 is translated upwards and locked by means of a serrated surface on engaging hook region 213*a* cooperating with a wedge shape portion 213*b* on the binding chassis. In this embodiment, additional serrated surfaces are provided for retaining lever 310 in an upwards position at an interface between lever 310 and cowling 300.

Figure 14:
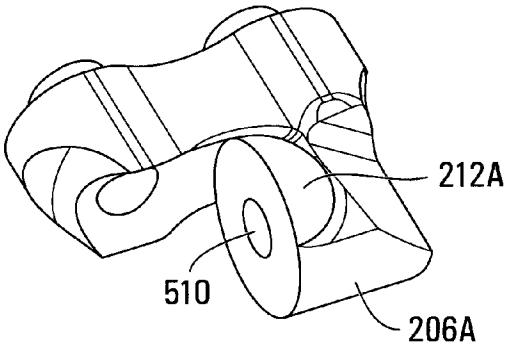
FIG. 14 is a perspective view of a part containing a portion of a generally spherical bearing for use in articulating jaws of this invention.
Figure 13B:
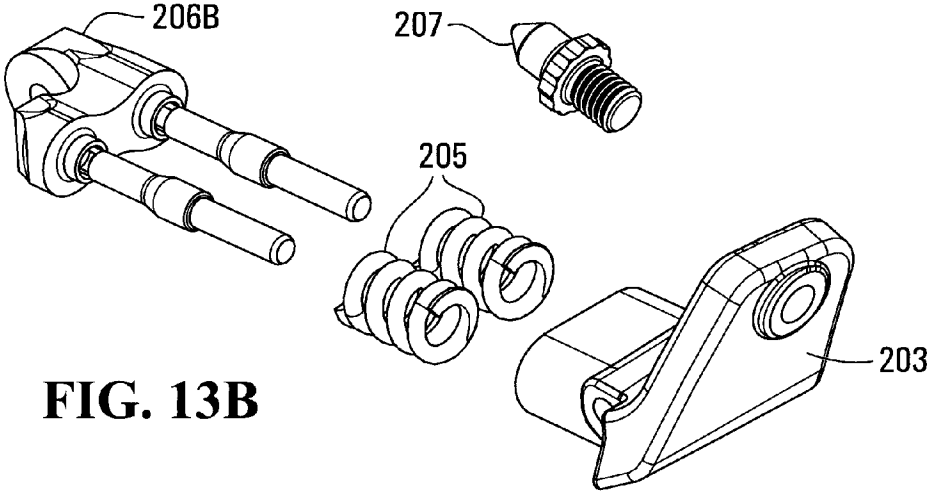
FIGS. 13A and 13B are perspective and exploded views, respectively, of a single jaw for use in a toe unit of this invention.
Figure 13A:
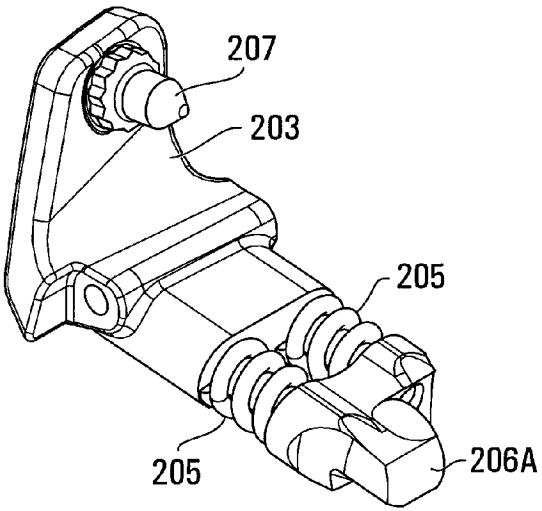

FIGS. 13A and 13B show an alternate jaw arrangement for use in this invention. The left jaw 203 is shown with its components assembled and the right jaw 203 is shown with its components in exploded view. In this embodiment, the left and right jaws terminate in mirror-image plunger parts 206*a* and 206*b*, each of which combine functions of plunger 106 and pivot ball 112 described above. In this embodiment, when both arms are installed, plunger parts 206*a* and 206*b* face one another and are joined by means of a pin inserted into a central opening 510 as shown in FIG. 14. Each of plunger part 206*a* and 206*b* contain a partial spherical member shown as 212*a* in FIG. 14. When joined, these two members form a generally spherical bearing.

A toe unit of this invention may include elastic/resilient components additional to the components described above (such as springs 105 and 205) that are used to bias the jaws to a closed position. Such additional components may include an anti-rattle device such as one biased against the control arm 116 or 216 to keep the control arm resting against pivot ball 112 or bearing 212. Such a device may be a torsion spring mounted on a common pivot axis with the control arm (such as pivot or pin 125/225 described above). The use of additional elastic/resilient components in a toe unit of this invention can also provide further advantages by allowing for release binding characteristics to exist when the binding is in the touring mode and/or to modulate lateral release characteristics when the binding is in the downhill mode.

When the jaws of a DYNAFIT™ toe unit are locked, it is possible to release the footwear toe from the toe unit by forcible deformation of binding components and/or the toe fittings. However, the amount of force required to release the toe from the DYNAFIT™ system when locked is quite high and beyond the range considered normal for release bindings. After repeated releases while locked, the amount of force required to release from the DYNAFIT™ may decrease but this can be due to excessive wear or deformation of the system components. However, by incorporating an elastic/resilient element in the present invention, one may provide for acceptable release characteristics when the binding is in the touring mode, so that the footwear will remain attached to the toe unit when subjected to forces normally experienced during touring manoeuvres but can be dislodged by more severe forces to reduce risk of injury to the user. Such a feature can also be selectively employed by the user to increase lateral release values of the binding system during downhill mode, while remaining within normally acceptable release values.

Incorporation of additional elastic/resilient aspects in a toe unit of this invention may be accomplished in a variety of ways. One way is to select or design the control arm to be an elastic/resilient component. For example, the control arm 116/216 described above may be constructed from an appropriate material such as steel (including stainless steel) so that the control arm will act as a leaf-spring, biased against the jaw components. Sizing and shaping of the control arm allows one to moderate the amount of release characteristics provided by the control arm when the arm is employed to retain the jaws in a closed position. Variations in the position of a fulcrum (such as pivot/pin 125 or 225) relative to the jaws can also be used to adjust the release feature. Alternatively (or in addition to the foregoing) additional elastic/resilient elements such as torsion or coil springs, elastomeric elements, etc. may be used. These may include (but are not limited to) a torsion spring (similar to the anti-rattle device described above) or springs, elastomeric elements, etc. which operate against the opposite end of the control arm relative to the jaws. One may also replace a touring mode locking mechanism such as those described above with elastic/resilient elements or one may provide such element(s) in combination with a locking mechanism.

Elastic/resilient components in a toe unit of this invention may operate in parallel or in series with themselves and/or in series or in parallel with a switching device. Such components may be provided to function only when a locking mechanism is not engaged or in combination with a locking mechanism. Provision of one or more additional elastic/resilient components to function in series with a locking mechanism in a toe unit of this invention, allows the user to increase the lateral release resistance of the binding in the downhill mode while remaining within normally acceptable lateral release levels. This could be done by locking the binding in to what would otherwise be the touring mode position and using the binding in this position for downhill manoeuvres. In this mode, and with reference to the foregoing examples, the control arm (116 or 216) acting as a leaf-spring is locked by tour mode lever 113/310. The leaf-spring provides higher resistance to opening of the jaws as compared to the resistance provided by coil springs (105, 205) alone.

In particular embodiments, the resilient elements which operate when the unit is locked will increase the amount of torque required to open the jaws by about 4 to about 6 DIN units.

Provision of multiple elastic/resilient release components in combination with a switching mechanism can be adapted to allow the user to modulate binding release values between several predetermined values that are each acceptable for binding release. By providing a switch mechanism for engaging or "locking-out" such multiple elements, the user may conveniently change from (for example) the operation of a different or multiple elastic/resilient element(s) (which provides higher release values) to an operation of a different or fewer elastic/resilient element(s) (which provides a lower release value). Such an arrangement may allow the user to change binding release values from one predetermined amount (or range of amounts) to another predetermined amount (or range of amounts). An example of this arrangement as applied to the exemplified embodiments of the present invention is the use of the tour-lock mechanism in series with an elastic/resilient control arm, in parallel with a set of springs which always bias the jaws to a closed position. The tour-lock mechanism acts as a switching mechanism which engages the control arm so that the control arm biased acting against the binding jaws becomes a release component operating in parallel with the springs which normally bias the binding to the closed position.

As is indicated above, the DYNAFIT™ system suffers from a disadvantage in that in order to change from the downhill mode to the touring mode, one should disengage the boot entirely from the binding so that the heel unit may be rotated and the pins in the heel unit will no longer engage with the boot heel. At that point, the toe is re-engaged with the toe unit. The toe unit embodiments described above can facilitate entry into the toe unit. Further advantage can be obtained from having the toe unit be capable of translation forward and rearward relative to the snow travel aid by the user. This can provide a system whereby the user does not have to disengage the footwear from the toe unit in order to disengage from the heel unit. Such a system may be provided for by allowing the toe unit to be translated forward along the longitudinal axis of the snow travel aid when it is intended to disengage the boot from the heel unit such as when switching to the touring mode. This can be provided by allowing for the toe unit to slide forward relative to the upper surface of the snow travel aid. A catch or some other mechanism for restraining the toe unit may be provided to hold the toe unit in a rearward position so that the footwear heel will remain engaged with the heel unit. A catch or restraint that restrains the toe unit in a forward translated position so the footwear may remain there during walking and climbing may also be provided. Having the footwear move forward for the touring position can be advantageous because shifting the toe unit forward shifts the touring pivot forward from the balance point of the snow travel aid, allowing the rear end of the snow travel aid to drop more easily. This can facilitate manoeuvres such as kick turns that are done with the heel free from the snow travel aid.

In some drawings described above, chassis 102 is shown fixed to base plate 101 by means of fasteners 111. Typically, the chassis will be located on the base plate at an appropriate location for positioning the footwear toe relative to the balance point for downhill sliding. However, one may readily appreciate that a chassis of a toe unit of this invention need not be permanently fixed but may be permitted to slidably engage a base plate with at least one catch provided to restrain the chassis relative to the base plate in a rearward position which would allow the footwear heel to engage the heel unit. A further catch or some other restraint may also be provided for retaining the chassis in a forward position for touring where the heel will be translated forward of the heel unit and no longer engaged with the pins of the heel unit. One may also appreciate that movement of the chassis relative to the base plate may be facilitated by mechanical means such as a lever. Also, solid or flexible links, including cable and pulley arrangements, etc. may be employed for connecting such a lever or other actuating mechanism to the chassis to provide for movement of the chassis relative to the base plate. A variety of mechanisms are known in the art both for translating a ski binding component relative to a snow travel aid surface and for restraining a binding unit at a desired position.

Figure 15:
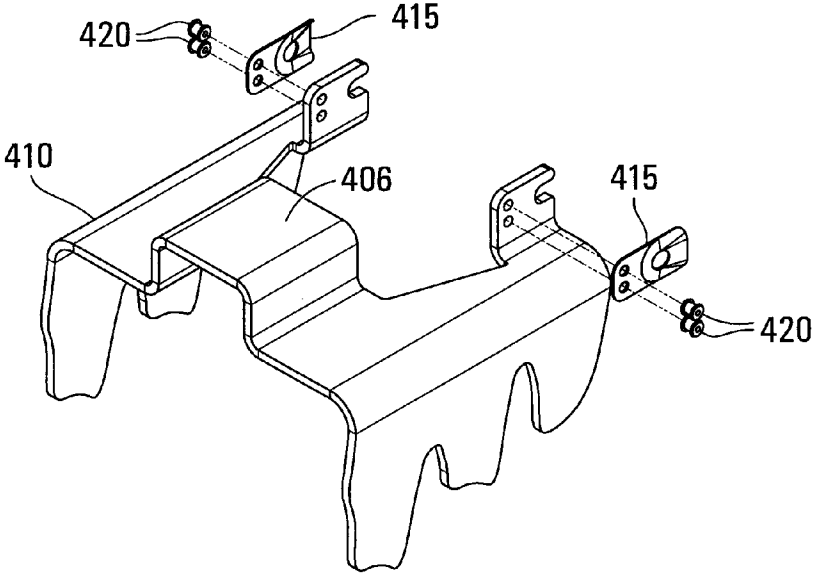
FIG. 15 is a perspective view of a crampon for use with a toe unit of this invention.
Figure 16:
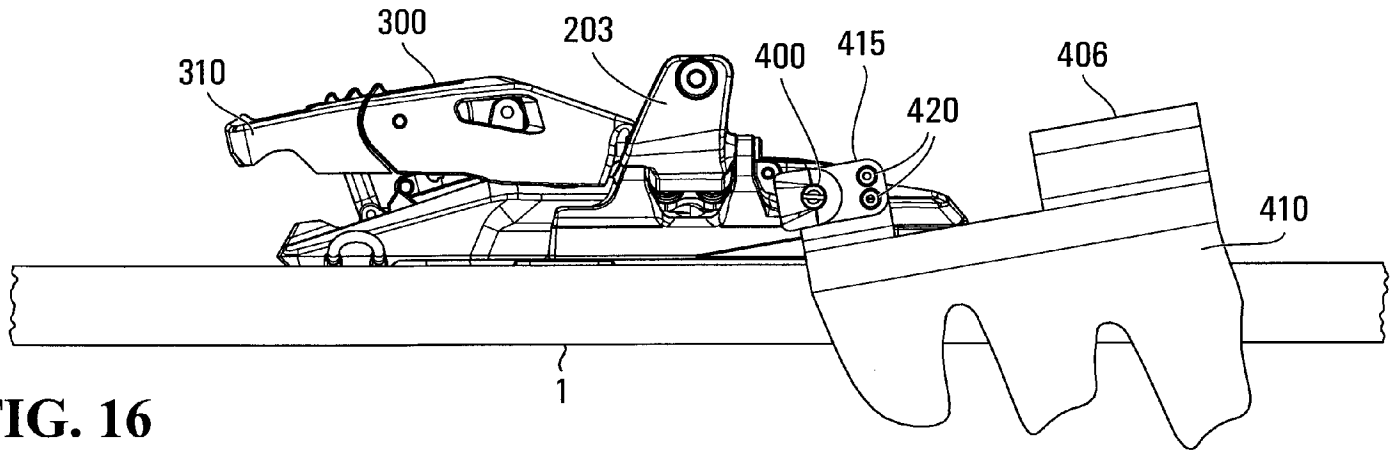
FIG. 16 is a side view of a toe unit of this invention with crampon and a portion of an associated ski.

FIG. 15 shows a crampon for use with the toe unit embodiment shown in FIG. 11. Crampon 410 comprises typical teeth 405 on each side of the crampon. The crampon may also comprise raised area 406 which is intended to support a boot sole when in use. Spring clips 415 are attached to front portions of the crampon by means of rivets 420 or other fasteners. The spring clips have resilient capabilities and contain a throughhole which covers an arcuate cut-out on a front portion of the crampon. The springs clips cooperate with posts 400 as shown in FIG. 11 to facilitate rapid attachment of the crampon to the toe unit and easy removal by biasing the spring clips outwards. FIG. 16 is a side view of a toe unit with attached crampon 410 shown relative to a partial portion of ski 1. Crampon 410 is illustrated in a slightly raised position which would be typical of what happens when the boot is raised and the ski is pushed forward along the snow surface. Lowering the boot will cause crampon 410 to pivot downwards biting into the snow surface beneath the ski.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the invention. All patents, patent applications and other publications referred to herein are hereby incorporated by reference.

What is claimed is:

1. An apparatus for holding a footwear toe to a snow travel aid when the heel of the footwear is detached from the snow travel aid, the apparatus comprising jaws that grasp the toe while permitting pivotal movement of the footwear about the toe in forward and rearward directions, wherein the apparatus comprises one or more resilient elements for biasing the jaws towards a closed position throughout an operational range of motion of said jaws, wherein the jaws comprise arms and wherein the apparatus further comprises a movable stop beneath the footwear toe which cooperates with the arms for restraining the jaws in an open position.

2. The apparatus of claim 1, wherein the jaws articulate with each other through a generally spherical bearing.

3. The apparatus of claim 1, wherein the movable stop comprises a wedge and wherein movement of the wedge causes opening of said jaws.

4. The apparatus of claim 1, wherein the arms articulate with each other through a generally spherical bearing and the movable stop contacts the generally spherical bearing.

5. The apparatus of claim 1, wherein the movable stop is actuated by a lever.

6. The apparatus of claim 5, wherein movement of said lever by a user in one direction opens the jaws and the jaws return to a closed position upon release of the lever by the user.

7. The apparatus of claim 1, further comprising a catch for restraining the movable stop while the jaws are in the open position.

8. The apparatus of claim 1, further comprising a support for contacting the footwear sole adjacent the footwear toe when the jaws are open.

9. The apparatus of claim 1, further comprising a toe stop that moves into position to be adjacent the footwear toe as the jaws open.

10. The apparatus of claim 9, wherein said movement of the toe stop and opening of the jaws is actuated by a single lever.

11. The apparatus of claim 1, wherein the jaws comprise two arms, the jaws open and close in directions generally perpendicular to the longitudinal axis of the snow travel aid and said arms articulate with each other beneath the footwear toe.

12. The apparatus of claim 1, wherein the jaws comprise a pair of conical teeth for engaging the footwear toe.

13. The apparatus of claim 12, wherein tips of the teeth are separated by a distance of about 65 mm when the jaws are fully open.

14. The apparatus of claim 1, further comprising a lock for inhibiting opening of the jaws.

15. The apparatus of claim 14, wherein the lock comprises a lever that contacts said jaws or a bearing through which said jaws articulate.

16. The apparatus of claim 15, wherein the lock is actuated by an additional lever.

17. The apparatus of claim 15, wherein the lever that contacts the jaws or bearing is a leaf-spring which provides resilience while inhibiting opening of the jaws.

18. The apparatus of claim 17, wherein the resilience allows for an increase of resistance to opening of the jaws when the lock is engaged by a DIN value of about 4 to about 6.

19. The apparatus of claim 14, wherein the lock further comprises one or more elements for providing resilience while inhibiting opening of the jaws.

20. The apparatus of claim 1, wherein the snow travel aid is a ski and the footwear is a ski boot.

21. The apparatus of claim 1, wherein the apparatus is adapted for generally horizontal, forward and rearward translation relative to a longitudinal axis of the snow travel aid, selectively by a user.

22. The apparatus of claim 21, in combination with a heel holder, the combination being mounted on the snow travel aid, the apparatus for holding the toe being translatable by the user in said generally horizontal, rearward and forward directions to provide for engagement and disengagement of the heel of the footwear with the heel holder.

23. A kit comprising the apparatus of claim 1, and a heel holder that provides for lateral release.

24. The apparatus of claim 1, in combination with a heel holder that provides for lateral release, said combination being mounted on the snow travel aid.

* * * * *